US006951433B2

(12) United States Patent
Reichel et al.

(10) Patent No.: US 6,951,433 B2
(45) Date of Patent: Oct. 4, 2005

(54) DEVICE FOR NONPOSITIVELY FIXING A BRACKET TO A SUPPORTING BASE BODY

(76) Inventors: Dieter Reichel, Badstrasse 13, D-92318 Neumarkt (DE); Jürgen Feix, Korschonsteiner Strasse 36, D-82110 Germering (DE)

( * ) Notice: Subject to any disclaimer, the term of this patent is extended or adjusted under 35 U.S.C. 154(b) by 9 days.

(21) Appl. No.: 10/169,851

(22) PCT Filed: Aug. 3, 2001

(86) PCT No.: PCT/EP01/09010

§ 371 (c)(1),
(2), (4) Date: Nov. 18, 2002

(87) PCT Pub. No.: WO02/12629

PCT Pub. Date: Feb. 14, 2002

(65) Prior Publication Data

US 2003/0118422 A1 Jun. 26, 2003

(51) Int. Cl.[7] ..... F16D 1/00
(52) U.S. Cl. ..... 403/408.1; 403/373
(58) Field of Search ..... 403/408.1, 373, 403/374.1, 374.2, 299; 104/281; 29/464

(56) References Cited

U.S. PATENT DOCUMENTS

| | | | | |
|---|---|---|---|---|
| 3,212,390 A | | 10/1965 | Litzkow | |
| 3,841,223 A | | 10/1974 | Bertin | |
| 3,890,904 A | | 6/1975 | Edwards | |
| 4,375,193 A | | 3/1983 | Sullivan | |
| 4,620,358 A | | 11/1986 | Miller et al. | |
| 4,631,772 A | | 12/1986 | Bonasso | |
| 4,698,895 A | | 10/1987 | Miller et al. | |
| 4,854,028 A | | 8/1989 | Buchler et al. | |
| 4,856,173 A | | 8/1989 | Maier et al. | |
| 4,870,906 A | | 10/1989 | Schaffer et al. | |
| 4,905,359 A | | 3/1990 | Maier et al. | |
| 4,909,474 A | | 3/1990 | Buchler et al. | |
| 4,970,773 A | | 11/1990 | Buchler et al. | |
| 4,987,833 A | | 1/1991 | Antosh | |
| 5,027,713 A | | 7/1991 | Kindmann et al. | |
| 5,131,132 A | | 7/1992 | Kindmann et al. | |
| 5,370,059 A | | 12/1994 | Raschbichler et al. | |
| 5,437,072 A | | 8/1995 | Dinis et al. | |
| 5,502,982 A | * | 4/1996 | Venetucci | 403/408.1 X |
| 5,651,318 A | | 7/1997 | O'Donohue | |
| 5,823,114 A | | 10/1998 | Cioletti et al. | |
| 5,850,794 A | | 12/1998 | Raschbichler et al. | |
| 6,385,869 B1 | * | 5/2002 | Steineman et al. | 403/408.1 X |
| 6,582,172 B2 | * | 6/2003 | Nickerson et al. | 403/408.1 X |

FOREIGN PATENT DOCUMENTS

| | | |
|---|---|---|
| CH | 653729 | 1/1986 |
| DE | 928047 | 4/1955 |

(Continued)

OTHER PUBLICATIONS

Dywidag–Berichte VIII, 1969, Nr. 2.
Patent Abstracts of Japan No. M–1126, Jun. 20, 1991.
U.S. Appl. No. 10/129,997, filed May 13, 2002.

(Continued)

*Primary Examiner*—John R. Cottingham
(74) *Attorney, Agent, or Firm*—Dority & Manning

(57) ABSTRACT

A device for nonpositively fixing a bracket to a supporting base body, especially a travel way body for railborne vehicles, has a tension member which protrudes partially from the supporting base body and extends partially into the supporting base body. The point of the protruding part of the tension member is located in a recess of the supporting base body. A support element may be arranged at least partially over the protruding part of the tension member, in which at least the front end of the support element is lying in the recess of the supporting base body. A bracket is located on the support element

21 Claims, 2 Drawing Sheets

FOREIGN PATENT DOCUMENTS

| | | | |
|---|---|---|---|
| DE | 2216484 | | 10/1973 |
| DE | 3322019 | A1 | 12/1984 |
| DE | 3412584 | A1 | 10/1985 |
| DE | 3639265 | A1 | 6/1988 |
| DE | 3709619 | A1 | 10/1988 |
| DE | 3825508 | C1 | 10/1989 |
| DE | 3924486 | C1 | 1/1991 |
| DE | 4021834 | A1 | 1/1992 |
| DE | 4115936 | A1 | 11/1992 |
| DE | 9217792.1 | | 8/1993 |
| DE | 4115935 | A1 | 11/1993 |
| DE | 4238310 | A1 | 3/1994 |
| DE | 29612404 | | 10/1996 |
| DE | 19619866 | | 11/1997 |
| DE | 19805086 | | 7/1998 |
| DE | 29809580 | | 10/1998 |
| DE | 19841936 | | 4/2000 |
| DE | 19919703 | | 11/2000 |
| EP | 0987370 | A1 | 3/2000 |
| GB | 2109437 | | 6/1983 |
| WO | 9951455 | | 10/1999 |
| WO | 0001888 | | 1/2000 |
| WO | 0020688 | | 4/2000 |

OTHER PUBLICATIONS

U.S. Appl. No. 10/169,822, filed Jul. 9, 2002.
U.S. Appl. No. 10/129,886, filed May 10, 2002.
U.S. Appl. No. 10/129,999, filed May 13, 2002.
EPO Search Report, Nov. 2, 2001.
German Patent Office Search Report, Mar. 21, 2001.
U.S. Appl. No. 10/049,096, filed Jun. 18, 2002.

* cited by examiner

DEVICE FOR NONPOSITIVELY FIXING A BRACKET TO A SUPPORTING BASE BODY

FIELD OF THE INVENTION

The invention relates to a device for nonpositively fixing a bracket to a supporting base body, in particular on a travel way body for railborne vehicles.

BACKGROUND

A device for nonpositively fixing a bracket to a structure is known from DE 33 22 019 A1. In this device forces acting parallel to the outer surface of the structure are transmitted to the structure via a plate. The plate is attached to the outer surface of the structure by means of tie rods installed within the structure. Saw tooth-like protrusions meshing with corresponding recesses on the outer surface of the structure are formed on the contact surface of the plate on the outer surface of the structure. The forces acting parallel to the outer surface of the structure are transferred by the saw-tooth-like protrusions and recesses in combination with the tensioning attachment of the plate to the structure. A bracket capable of supporting high-pressure loads parallel to the outer surface of the structure is then attached to the plate. To attach the bracket to the plate, a tie rod is prolonged by means of a bushing. For the force transmission by means of the teeth it is necessary to form saw-tooth-like protrusions on the plate as well as the saw-tooth-shaped recesses on the structure during its construction. For this purpose the prefabricated concrete part of the structure which will later support the bracket is cast as a shuttering element by using the plate, and the plate is then removed. When the plate is removed from the prefabricated concrete part, the two elements are marked so they can be fitted together precisely once more for final assembly. This causes the production and assembly processes of the device to be very expensive.

A device of the same type for non-positive attachment of a bracket to a support of a travel way for a magnetically levitated train is known from DE 41 15 936 A1. In this device a built-in plate is embedded in the cement on the support and serves as contact surface for a corresponding surface of the bracket. A tie rod to which the bracket is screwed runs through the support and through a bore in the built-in plate. The contact surfaces of the built-in plate and of the bracket have recesses across from each other into which a spacer bushing is inserted. To mount the bracket to the support the spacer bushing is first pushed over the tie rod and the bracket is then set on the tie rod. The spacer bushing and an additional spacer between the built-in plate and the bracket are used to adjust the precise track width of the travel way. It is however necessary to embed the built-in plate into the support when manufacturing a support made of reinforced or prestressed concrete, so that manufacture becomes expensive. In addition the capability of transmitting a force acting parallel to the surface of the support from the bracket to the support is reduced, because the built-in plate and the bracket are separated from each other by the spacer bushing. The spacer and the transmission of the transversal force takes place via a lever.

SUMMARY OF THE INVENTION

It is therefore one object of the present invention to provide a device for nonpositive fixing of a bracket to a supporting base body whereby the transmission of a force acting parallel to the surface of the supporting base body is reliably ensured with a simple design of the device.

In one embodiment, a tension member protrudes from a recess in a supporting base body. A bearing element is provided over the protruding end of the tension member and in turn protrudes from the outer surface of the supporting base body in a preferred embodiment, while the forward end of the bearing element is preferably seated nonpositively in the recess. A bracket which is to be provided on the supporting base body is located on the bearing element. The bearing element is advantageously made in the form of a bushing or sleeve. This makes simple and cost saving production of the bearing element possible. In another embodiment according to the invention, both ends of the bearing element are in the recess and the bracket bears at least in part in the recess on the bearing element.

If a force directed parallel to the outer surface of the supporting base body acts upon the bracket, that force is transferred by the bracket to the bearing element and from the latter to the supporting base body. This prevents a force directed at a right angle to the tension member from acting on the tension member and possibly damaging it. Additionally the cross-section of the bearing element is larger than the cross-section of the tension member. As a result a larger surface is available for the transfer of the force from the bracket to the supporting base body and the surface load of the supporting base body is reduced when a transversal force is transferred, so that greater stability is achieved.

If the console is fixed on two tension members and bearing elements, an especially secure and force-absorbing arrangement of the console on the supporting base body is achieved.

If the tension member, the bearing element and/or a fixing element of the bracket are placed coaxially to each other, a simple construction and easy mounting of the bracket is made possible in an especially advantageous embodiment of the invention.

The bracket to be attached is preferably provided with a recess that receives the rear end of the bearing element. Thus, an especially good connection and force transfer is achieved.

To transfer the lateral force it is not necessary to adapt the outer surface of the supporting base body when producing it to a given contact plate or to embed contact elements into the supporting base body.

The fixing of the bracket can be effected by only one tension member or by using several tension members extending in parallel through the supporting base body. The utilization of two tension members has proven to be especially advantageous.

In an advantageous embodiment the tension member runs completely through the supporting base body. A second device for the fixing of a bracket is provided on the exit side of the tension member on the side across from the first fixing device. In that case only one tension member must be provided to fix two brackets. Furthermore the distance between the brackets can be determined by means of the distance at which the brackets are fixed from each other on the tension member or the bearing element.

If the brackets are fixed on the tension member while applying a tensile force on both sides, a tensile force is applied to the supporting base body via the tension member and the brackets, stabilizing the supporting base body itself. If the supporting base body is a part of a travel way made of reinforced concrete, the tension members can replace transversal tension elements to fix the brackets. Thereby, the costs are reduced in the production and repair of travel way elements.

In an especially advantageous embodiment the tension member is inserted through a pipe or hole in the supporting base body so that the tension member can be introduced into the supporting base body or can be removed from it if necessary after completion of the supporting base body. Thereby inspection of the tension member or its replacement is facilitated without having to damage the supporting base body.

If the tension member is sheathed with a corrosion protection before being anchored in the supporting base body or before it is introduced through a pipe or hole in the supporting base body, the tension member's resistance to weather is increased. A shrink hose pulled over the tension member or a plastic sheathing is for example a suitable corrosion protection.

Another embodiment of the device to fix the bracket is obtained by attaching the bracket to the protruding end of the tension member. It is therefore not necessary to provide any additional attachment means to fix the bracket on the supporting base body.

In an especially advantageous embodiment the bearing element is connected nonpositively to the tension member in the longitudinal direction of the tension member. Consequently the tension member can be braced on the supporting base body by the bearing element with the exertion of compressive strain. Therefore the bracing of the supporting base body is maintained, and in case that the bracket is removed for replacement or inspection from the supporting base body. In case that the tension member is introduced loosely through a hole or pipe in the supporting base body, and the tension member remains firmly anchored in the supporting base body. If brackets are attached at both ends of the tension member the first bracket can be removed on one side without the second bracket coming loose on the opposite side.

The nonpositive connection between bearing element and tension member is achieved most advantageously in that the protruding part of the tension member is provided with outside threads and in that the bearing element is made in form of a bushing with inside threads. By screwing the bushing on the tension member the fixing of the bearing element on the tension member is achieved in an especially easy manner. Also, the bracing of the tension member in the supporting base body is in that case possible.

By applying adhesive before screwing the bushing on the tension member the bushing can be secured against later detachment. This securing can however also be achieved by means of a counter-nut, a cotter pin or some other securing means.

In another especially advantageous embodiment the bushing is longer than the protruding end of the tension member, and a threaded bolt or screw can be screwed into the rear portion of the bushing. The bracket is then fixed by means of a screw inserted into the bushing or by means of the threaded bolt on which a nut is screwed. In this manner the tension member is prolonged on the outside of the supporting base body and the prolongation serves to fix the bracket on the supporting base body. Therefore the tension member and the prolongation of the tension member can be made of different materials. Thus the portion of the tension member extending essentially inside the supporting base body can be made of a suitable steel or iron that need not meet such high requirements with respect to corrosion resistance.

Alternatively or in addition, the tension member can be optimized to lowest possible temperature expansion coefficients. If the tension member runs through the supporting base body and if brackets are fixed on both sides, it is possible that the track be subjected to only minimal changes of transversal expansion despite fluctuation of the outside temperature, independently of the expansion of the supporting base body.

On the other hand the prolongation end on the outside of the supporting base body can be optimized with respect to corrosion resistance by using a special steel bolt or a special steel screw.

Alternatively, the bracket can be fixed on the rear portion of the bushing that protrudes from the outer surface of the supporting base body. For this, outside threads are preferably provided on the bushing so that when the bracket has been installed over the bushing, the bracket can be attached by means of a nut to the bushing.

In another embodiment the end piece of the tension member and the recess in the supporting base body extend to the outside of the supporting base body at a defined angle, e.g. up at a slant, so that when a load bears on the attached bracket parallel to the outer surface of the supporting base body, part of the force is transmitted in axial direction of the bearing element to the supporting base body.

If the bearing element is integrated in the bracket in form of a protrusion, the bracket can be made in different ways. The bracket can for example be made in form of a cast element, or out of several rolled profiles. The integrated bearing element is therefore easy to handle and assembly is facilitated.

If the tension member is introduced through the bearing element and into and through the bracket and if it serves to fix the console, a simple embodiment of the invention is created also in this manner.

BRIEF DESCRIPTION OF THE DRAWINGS

The present invention is explained in further detail below through examples of embodiments as set forth.

DETAILED DESCRIPTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention.

Figure 1:
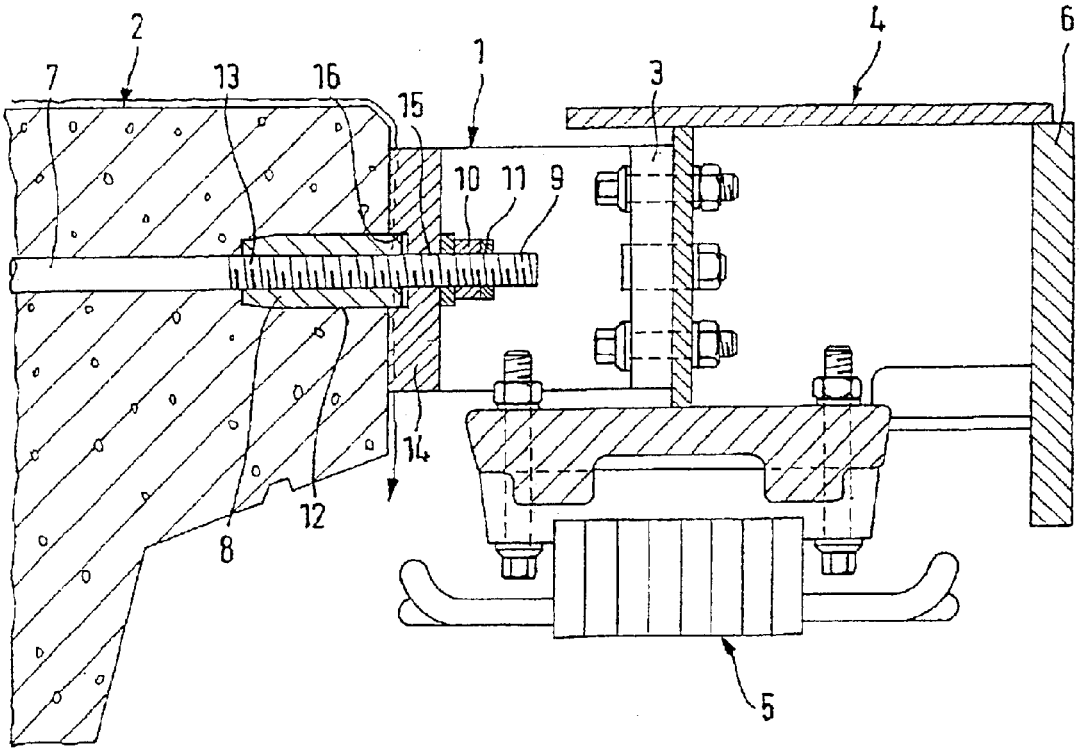
FIG. 1 shows a lateral cross-sectional view of a fixing device according to the invention for the fixing of a bracket to a travel way.

FIG. 1 shows a lateral cross-sectional view of a device to attach a bracket 1 to a lateral surface of a reinforced concrete support 2 for the travel way of a magnetically levitated train. A built-on element 4 is screwed to a head plate 3 of the bracket 1. On the underside of element 4, a stator package 5 is arranged that drives and guides the magnetically levitated train. On the side of the element 4, a lateral guiding plane 6 is arranged. The fixing arrangement comprises a tension tie rod 7, a bushing 8, a threaded bolt 9, a nut 10 and a counter-nut 11.

The tie rod 7 extends at a right angle to the direction of the travel way through the reinforced concrete support 2 and emerges on both sides of the support 2 from a recess 12 in the reinforced concrete. The tie rod 7 is a rod made of special steel and is passed loosely in a plastic pipe through the support 2. In an alternative embodiment the tie rod 7 can be embedded in the concrete of the support 2. The tie rod 7 is provided on both of its ends with threads produced by rolling the ends 13. With the exception of the threads 13, the tie rod 7 is encased in a shrink hose so that the corrosion of the tie rod 7, from water entering the travel way or the support 2 is prevented.

During the fabrication of the support 2 as a prefabricated prestressed concrete element the plastic pipes that will receive the tie rods 7 are already imbedded into the concrete. Also, the recesses 12 are produced already during the casting of the concrete, by means of styropor forming parts or rubber sleeves. After casting and hardening of the prefabricated travel way part the styropor parts are removed and the tie rod is inserted.

After the insertion of the tie rod 7 into the support 2, the bushings 8 are screwed on the two threaded ends 13 of the tie rod 7. They can be fixed on the tie rod ends 7 by means of adhesive. In this case the forward portion of the bushing 8 matches the previously embedded and then removed form of the styropor form element or of the rubber sleeve that was removed after the hardening of the concrete, so that the forward part of the bushing 8 is seated in a non-positively locking manner with only little clearance in the recess 12. The rear end of the bushing 8 protrudes over the lateral edge of the support 2. When the bushing 8 has been fixed to the end 13 of the tie rod, the threaded bolt 9 is screwed into the bushing 8.

Then, a bottom plate 14 of the bracket 1 is pushed over the protruding threaded bolt 9 and the protruding end of the bushing 8. For this purpose a first bore 15 with a diameter that is only slightly greater than the diameter of the threaded bolt 9 is provided in the bottom plate 14. The cross-section of the first bore 15 is enlarged by a second bore 16 on the contact side with the edge of the support 2, whereby the cross-section of the second bore 16 is slightly greater than the outside diameter of the bushing 8.

The depth of the second bore 16 is greater than the length of the end of bushing 8 protruding from the lateral edge of the support 2, so that the bottom plate 14 of the bracket 1 lies completely on the lateral surface of the support 2. As a result, the manufacturing tolerance in producing the recess 12 on the lateral face of the support 2 is for example compensated for. The air gap between the bracket 1 and the sleeve 8 in the second bore 16 is shown in detail in FIG. 2. A clearance due to different expansion of the travel way dimensions of the support 2 and the tie rod 7 can also be compensated for by means of the air gap by a movement of the bushing 8 in the second bore 16.

The bracket 1 is attached to the threaded bolt 9 by means of nut 10 that is secured by a counter-nut 11. Alternatively the bracket can be attached with a cap nut instead of with the nut 10 and the counter-nut 11.

The brackets which are installed at the two ends of the tie rod 7 are attached in symmetric construction and therefore only one side of the fixing of the brackets 1 is shown in FIG. 1 and stands for both sides.

Figure 2:
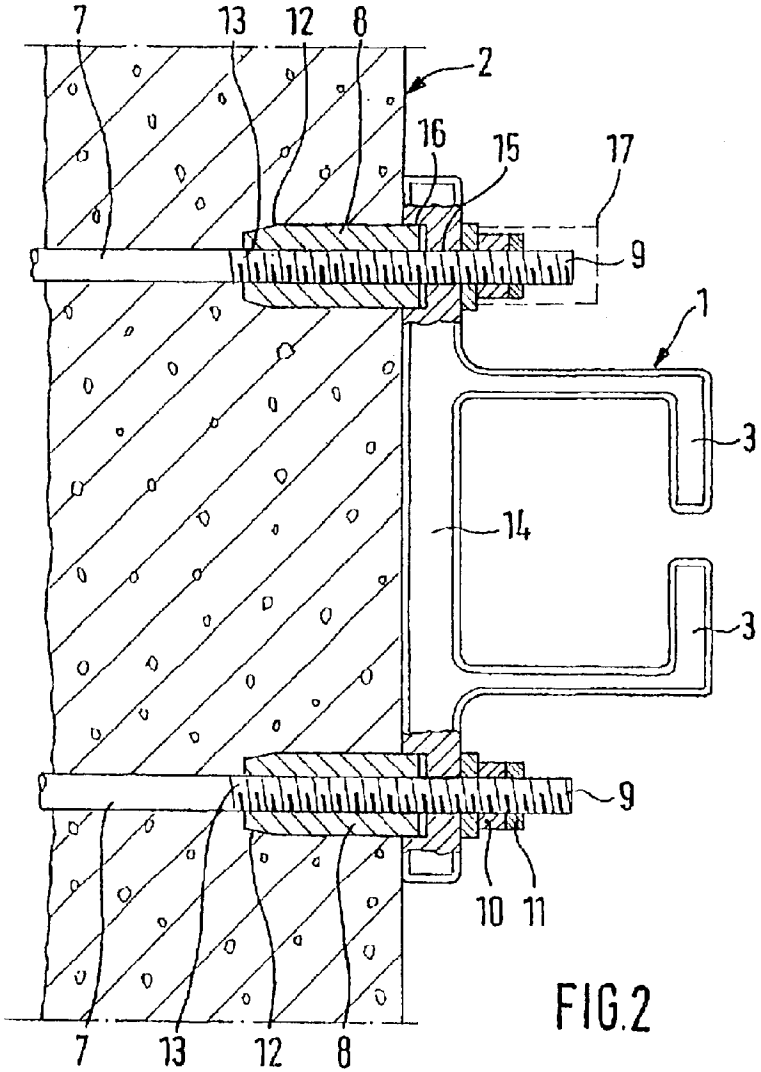
FIG. 2 shows a cross-sectional view of the fixing device to fix the bracket, in a top-view

FIG. 2 shows a cross-sectional view of the fixing device to fix the bracket 1 to the side of the support 2, as seen from the top. The bracket 1 is attached by means of two tie rods 7 placed one behind the other in travel direction. When the bracket 1 has been attached, a covering cap 17 is placed over the protruding end of the threaded bolt 9, the nut 10 and the counter-nut 11 for protection against corrosion.

In producing the bracket 1, the head plate 3 was made with an excess dimension on the side of the built-on part 4 to be mounted later (FIG. 1). This can be ground off after mounting the bracket on the face of the support 2 to compensate for manufacturing tolerances of the support 2 in the direction of the travel way so that the precise measurements of the travel way width when the built-on part 4 is then attached to the head plate 3.

Figure 3:
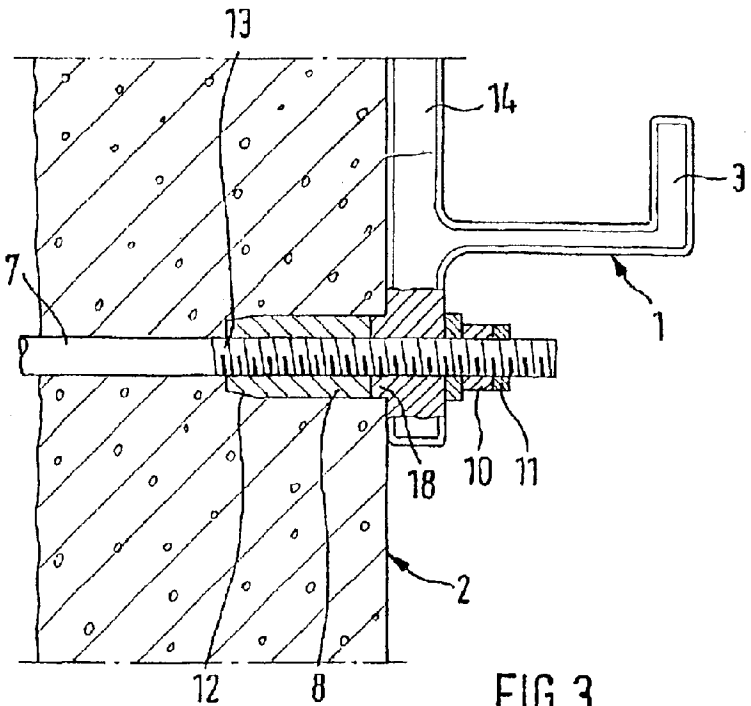
FIG. 3 shows a cross-sectional view of another fixing device to fix a bracket, in a top view.

FIG. 3 shows another embodiment of the invention. The functions are the same as in the previous examples. A bushing 8 is inserted with both of its ends into the recess 12 of the support 2. The tie rod 7 extends through the bushing 8 and the bottom plate 14 of the bracket 1. The bracket is tightly pressed against the bushing 8 by being screwed to the tie rod, and thereby bears on the bushing 8. The bottom plate 14 of the bracket 1 has a prolongation 18 which extends into the recess 12 and thus provides an additional support of the bracket 1 in that it corresponds to the bearing element. The prolongation 18 can replace the bushing 8 completely or take over the function of the bushing. In that case the bearing element is completely integrated into the bracket.

The bearing element need not be rotationally symmetrical as shown in the examples of embodiments. It can also be oblong and may possibly be less expensive to manufacture, in combination with the bottom plate of the bracket.

It should be apparent to those skilled in the art that modifications and variations can be made to the embodiments of the invention described herein without departing from the scope and spirit of the invention as set forth in the appended claims and their equivalents

What is claimed is:

1. A bracket assembly for fixing a bracket to a supporting base body in a railborne vehicle support system, said system comprising:

a tie rod mechanism having a portion fixed within the supporting base body and a first end protruding from the supporting base body and a second end protruding from an opposite side of said supporting base body;

a recess defined in each side of the supporting base body at each said end of said tie rod mechanism, each said protruding end of said tie rod mechanism extending from said supporting base body and out through said recess;

a bearing element disposed around said protruding ends of said tie rod mechanism, said bearing element comprising a forward end disposed within said recess; and a bracket mounted relative to the supporting base body by being fixed onto each said bearing element.

2. The assembly as in claim 1, wherein said bearing element comprising a generally cylindrical bushing component extending longitudinally at least partially within said recess.

3. The assembly as in claim 1, wherein said bearing element comprises a rear end opposite from said forward end, said rear end extending from said recess beyond said supporting base body, said bracket fixed onto said extending rear end of said bearing element.

4. The assembly as in claim 3, wherein said bracket comprises a recess defined in a back surface thereof disposed against said supporting base body, said extending rear end of said bearing element received in said bracket recess.

5. The assembly as in claim 1, wherein said bracket is mounted against said supporting base body in a non-positively engaged manner.

6. The assembly as in claim 1, further comprising an additional tie rod mechanism and associated bearing element disposed in an additional recess in said supporting base body, said bracket removably fixed to said additional bearing element.

7. The assembly as in claim 1, wherein said tie rod mechanism and said bearing element are coaxial.

8. The assembly as in claim 1, wherein said tie rod mechanism is embedded within said supporting base body.

9. The assembly as in claim 1, wherein said tie rod mechanism is disposed within a concentric passage within the supporting base body where it passes through the supporting base body.

10. The assembly as in claim 9, wherein the supporting base body is a prefabricated concrete element, said passage defined by a pipe-like element provided during formation of the supporting base body.

11. The assembly as in claim 1, wherein the supporting base body comprises a prefabricated concrete element, said tie rod mechanism sheathed in a corrosion protective coating.

12. The assembly as in claim 1, wherein said bearing element comprises a generally cylindrical element disposed concentric on said tie rod mechanism.

13. The assembly as in claim 12, wherein said bearing element tensions said be rod mechanism in a longitudinal direction.

14. The assembly as in claim 13, wherein said bearing element is rotatable relative to said tie rod mechanism.

15. The assembly as in claim 14, wherein said bearing element is threadedly engaged with said tie rod mechanism.

16. The assembly as in claim 10, wherein said bearing element is fixed onto said tie rod mechanism by one of a glued, clamped, and pressfitted connection.

17. The assembly as in claim 1, wherein said bearing element completely encircles said protruding end of said tie rod mechanism and comprises a threaded opening therethrough, said tie rod mechanism further comprising a threaded member extending through and threadedly engaged with said bearing element, said bracket mounted onto said threaded member.

18. The assembly as in claim 17, wherein said bracket is mounted onto said threaded member with a nut.

19. A bracket assembly for fixing a bracket to a supporting base body in a railborne vehicle support system, said system comprising:

a tie rod mechanism having a portion fixed within the supporting base body and a first end protruding from the supporting base body;

a recess defined in the supporting base body, said protruding end of said tie rod mechanism extending through said recess;

a bearing element disposed around said protruding end of said tie rod mechanism, said bearing element comprising a forward end disposed within said recess;

a bracket mounted relative to the supporting base body by being fixed onto said bearing element; and wherein said bearing element comprises at least in part a protrusion extending from a back side of said bracket into said recess.

20. The assembly as in claim 19, wherein said protrusion is formed as an integral component with said bracket.

21. The assembly as in claim 19, wherein said bearing element further comprises a bushing element received in said recess through which said tie rod mechanism passes.

* * * * *